US011774046B2

(12) United States Patent
Li et al.

(10) Patent No.: US 11,774,046 B2
(45) Date of Patent: Oct. 3, 2023

(54) LED LIGHT SOURCE ASSEMBLY AND HIGH-POWER LAMP USING THE SAME

(71) Applicants: ZHEJIANG YANKON MEGA LIGHTING CO., LTD., Zhejiang (CN); ZHEJIANG YANKON GROUP. CO., LTD., Zhejiang (CN)

(72) Inventors: Yang Li, Zhejiang (CN); Chao Fu, Zhejiang (CN); Zhenghong Ma, Zhejiang (CN); Weijun Zhang, Zhejiang (CN); Bingshuang Zhang, Zhejiang (CN)

(73) Assignee: ZHEJIANG YANKON MEGA LIGHTING CO., LTD., Zhejiang (CN)

( * ) Notice: Subject to any disclaimer, the term of this patent is extended or adjusted under 35 U.S.C. 154(b) by 460 days.

(21) Appl. No.: 17/042,095

(22) PCT Filed: Sep. 8, 2020

(86) PCT No.: PCT/CN2020/113862
§ 371 (c)(1),
(2) Date: Sep. 26, 2020

(87) PCT Pub. No.: WO2021/179554
PCT Pub. Date: Sep. 16, 2021

(65) Prior Publication Data

US 2023/0130607 A1 Apr. 27, 2023

(30) Foreign Application Priority Data

Mar. 12, 2020 (CN) ..... 202010171137.9
Aug. 14, 2020 (CN) ..... 202010818678.6

(51) Int. Cl.
*F21K 9/232* (2016.01)
*F21K 9/237* (2016.01)
(Continued)

(52) U.S. Cl.
CPC ..... *F21K 9/237* (2016.08); *F21K 9/232* (2016.08); *F21Y 2105/10* (2016.08); *F21Y 2107/30* (2016.08); *F21Y 2115/10* (2016.08)

(58) Field of Classification Search
CPC ..... F21K 9/237; F21K 9/232; F21Y 2105/10; F21Y 2107/30; F21Y 2115/10
See application file for complete search history.

(56) References Cited

U.S. PATENT DOCUMENTS 5,806,965 A * 9/1998 Deese ..... F21K 9/232 362/249.06
2001/0036082 A1* 11/2001 Kanesaka ..... G09F 9/33 362/555

(Continued)

FOREIGN PATENT DOCUMENTS

CN 102203501 A 9/2011
CN 103016987 A 4/2013

(Continued)

OTHER PUBLICATIONS

International Search Report and Written Opinion of the International Searching Authority dated Dec. 1, 2020 for PCT/CN2020/113862.

*Primary Examiner* — Evan P Dzierzynski
(74) *Attorney, Agent, or Firm* — Yue (Robert) Xu; Apex Attorneys at Law, LLP

(57) ABSTRACT

An LED light source assembly and a high-power lamp using the LED light source assembly is provided, wherein, the LED light source assembly includes a LED light source board and an electric connector. The LED light source board is provided with two electrodes which are arranged in the longitudinal direction of the LED light source board and parallel to each other, and one end of the electric connector is provided with a pin assembly and another end of the LED light source board is provided with a socket assembly to (Continued)

make one end of the LED light source board in the longitudinal direction connected to one side of the electric connector, and another end of the rolled LED light source board in the longitudinal direction of the LED light source board is connected to another side of the electric connector.

16 Claims, 12 Drawing Sheets

(51) Int. Cl.

| | |
|---|---|
| *F21Y 107/30* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2006/0193130 | A1 | 8/2006 | Ishibashi | |
| 2010/0284188 | A1* | 11/2010 | Chen | F21K 9/232 362/249.02 |
| 2011/0204393 | A1 | 8/2011 | Masumoto et al. | |
| 2020/0284399 | A1* | 9/2020 | Roys | F21V 23/02 |

FOREIGN PATENT DOCUMENTS

| | | | |
|---|---|---|---|
| CN | 203052306 | U | 7/2013 |
| CN | 203223772 | U | 10/2013 |
| CN | 203823495 | U | 9/2014 |
| CN | 111350961 | A | 6/2020 |

* cited by examiner

LED LIGHT SOURCE ASSEMBLY AND HIGH-POWER LAMP USING THE SAME

The present application is a national phase of International Application No. PCT/CN2020/113862, titled "LED LIGHT SOURCE ASSEMBLY AND HIGH-POWER LAMP USING THE SAME", filed on Sep. 08, 2020, which claims the benefits of priorities to the following two Chinese patent applications, both of which are incorporated herein by reference in their entireties, 1) Chinese Patent Application No. 202010818678.6, titled "LED LIGHT SOURCE ASSEMBLY AND HIGH-POWER LAMP USING THE SAME", filed with the China National Intellectual Property Administration on Aug. 14, 2020, and
2) Chinese Patent Application No. 202010171137.9, titled "LED LIGHT SOURCE ASSEMBLY AND HIGH-POWER LAMP USING THE SAME", filed with the China National Intellectual Property Administration on Mar. 12, 2020.

FIELD

The present application relates to LED products, and in particular to an LED light source assembly and a high power lamp using the LED light source assembly.

BACKGROUND

LED has gradually replaced a traditional incandescent lamp and an energy-saving lamp because of its advantages of energy saving, high efficiency and environmental protection, and has been widely used in ordinary households.

Since the LED is a point light source with a small area, only 30~50% of input electric energy is output in a form of light, and the remaining 50~70% is released in a form of heat, so that the heat generation of the LED is large and concentrated, and the heat has a great influence on LED luminescence. In order to solve this technical problem, it is necessary to use a heat sink to dissipate heat. Usually, the LED is mounted on the surface of the heat sink to dissipate heat. However, the larger the LED power, the larger the volume of the heat sink is required. As a result, the LED lamp is not only bulky and heavy, but also expensive.

SUMMARY

The technical problem to be solved by the present application is to provide an LED light source assembly and a high-power lamp using the LED light source assembly, which does not require a heat sink, has good heat dissipation effect, and is light in weight and low in price.

The following technical solutions are provided according to the present application to solve the above technical problems.

An LED light source assembly includes an LED light source board, and further includes an electric connector. The LED light source board is provided with two electrodes which are arranged in a longitudinal direction of the LED light source board and parallel to each other. One end of the electric connector is provided with a pin assembly and another end of the electric connector is provided with a socket assembly, so that one end of the LED light source board in the longitudinal direction of the LED light source board is connected to one side of the electric connector. Another end of the rolled LED light source board in the longitudinal direction of the LED light source board is connected to another side of the electric connector, and the pin assembly is electrically connected to one of the two electrodes close to the pin assembly, and the socket assembly is electrically connected to the other electrode close to the socket assembly to form the LED light source assembly with a cylindrical structure as a whole.

The LED light source board includes the two electrodes and multiple LED light bars arranged along the longitudinal direction of the LED light source board and arranged in parallel between the two electrodes. One of the two electrodes and the LED light bar closest to the electrode, two adjacent LED light bars, and the other electrode and the LED light bar closest to the electrode are all connected into a whole through plastic connectors. One of the two electrodes and the LED light bar closest to the electrode, two adjacent LED light bars, and the other electrode and the LED light bar closest to the electrode are all electrically connected through electrical connecting wires.

The electric connector includes an upper cover, an electric connecting board, a box-shaped lower cover, the pin assembly and the socket assembly. The pin assembly is arranged on one end of a front of the electric connecting board, and the socket assembly is arranged on another end of the front of the electric connecting board. Plug terminals for plugging the two electrodes are symmetrically provided at two ends of one side of the front of the electric connecting board, and plug ports of the plug terminals face an outer side of the electric connecting board. A pin in the pin assembly is electrically connected to one of the plug terminals close to the pin through a circuit of the electric connecting board, and a connecting guide pin in the socket assembly is electrically connected to another plug terminal close to the connecting guide pin through the circuit of the electric connecting board. The lower cover is provided with an accommodating cavity, and the pin assembly and the socket assembly are exposed outside the lower cover after the electric connecting board is placed in the accommodating cavity. The upper cover is covered on the electric connecting board, and after the upper cover and the lower cover are matched and connected, insertion ports for inserting ends in the longitudinal direction of the LED light source board are respectively formed in two sides between the upper cover and the lower cover. Here, the size of the upper cover is required to be slightly smaller than that of the lower cover in design, so that the plug terminals are exposed outside the upper cover, that is, outside the insertion ports. After the ends of the longitudinal direction of the LED light source board insert into the insertion port, the ends are upturned to abut against the inner side of the upper cover.

Positioning holes are respectively provided at two ends of each electrode in a longitudinal direction of the electrode, and a notch is formed by cutting one end of the plastic connector connecting the electrode and the LED light bar in a longitudinal direction of the plastic connector. The notch extends to the closest positioning hole. Two positioning pillars are respectively arranged on two sides of the lower cover, and the positioning pillars are respectively positioned outside the insertion ports, and each of the positioning pillars is matched with the corresponding positioning hole to achieve positioning. One end of the LED light source board with the notch is inserted into one of the insertion ports on a same side as the plug terminals, while another end of the LED light source board is inserted into the other insertion port, and parts of the electrodes separated by the notch are inserted into the plug terminals. Here, the positioning connection between the LED light source board and the electric connector is achieved by the matching of the positioning hole and the positioning pillar. The arrangement of the notch makes the corresponding part of the electrodes have good elasticity, so that the part of the electrodes can be smoothly inserted into the plug terminals, while ensuring the reliability of the electrical connection.

Two mounting strips are provided on the inner side of the upper cover in a longitudinal direction of the upper cover, a positioning strip is provided between middle positions of the two mounting strips, and a mounting pillar with a screw hole is arranged at each edge position between the two mounting strips. The electric connecting board is provided with positioning through holes for the positioning strips to pass through, and mounting holes for the mounting pillars to pass through. A positioning seat matched with the positioning strips and provided with a positioning groove is provided at a bottom of the accommodating cavity. Screw penetration holes matched with the mounting pillars are provided at the bottom of the accommodating cavity. After the upper cover and the lower cover are matched and connected, the bottoms of the two mounting strips abut against the front of the electric connecting board so that the insertion ports are respectively formed on both sides between the upper cover and the lower cover. Here, two mounting strips are used to abut against the front of the electric connecting board to make the upper cover and the lower cover have a larger distance to form the insertion ports. The matching of the positioning strip with the positioning through hole and the positioning groove achieves the positioning connection among the upper cover, the electric connecting board and the lower cover, so that the upper cover, the electric connecting board and the lower cover can be quickly mounted together. The arrangement of the mounting pillars, the mounting holes, and the screw penetration holes allows the upper cover, the electric connecting board, and the lower cover to be connected as a whole by screws. The upper cover, the electric connecting board and the lower cover can be fixedly connected by a snap connection in actual design.

The LED light bar includes a metal substrate, and multiple LED units are sequentially processed on the metal substrate in a longitudinal direction of the metal substrate. Each LED unit includes a heat sink, an upper lead section located above the heat sink, a lower lead section located below the heat sink and an LED chip. The heat sink is not connected to the upper lead section and the lower lead section, and two ends of the upper lead section are correspondingly connected to two ends of the lower lead section through a connecting bridge. Two ends of the heat sink are wide and a middle part of the heat sink is narrow to form an inner recess. A protrusion that protrudes in a direction of the heat sink and is embedded in the inner recess is respectively provided on a middle part of the upper lead section and a middle part of the lower lead section. The LED chip is mounted on a narrow area in the middle part of the heat sink, and two chip electrodes of the LED chip are respectively electrically connected to the two protrusions through wires. The LED chip is coated with fluorescent glue, and all the LED chips are connected in series or in series and parallel by punching the connecting bridge. Here, the heat sink, the upper lead section and the lower lead section are formed directly on the metal substrate through the existing punching process. During processing, the two ends of the upper lead section are connected to the two ends of the lower lead section by a connecting bridge. When designing the circuit, the connecting bridge is punched according to the connection requirements of all the LED chips to make all the LED chips connected in series or in series and parallel.

A first current limiting device is arranged on the front of the electric connecting board, and the first current limiting device is connected in series with the LED chip in the LED light source board that is electrically connected to the electric connecting board. The surface of the LED light bar and the surface the electrode are covered with a first protective layer. Here, after the first current limiting device is arranged, the current of the LED light source board can be adjusted by the driving power supply, thereby controlling the power of the LED light source board and ensuring the normal operation of the LED light source board. The arrangement of the first protective layer can increase the insulation of the LED light bar and the electrode, complies with safety regulations, and prevents the risk of electric shock.

A high-power lamp using the LED light source assembly includes a lamp cap, a lamp body and a driving power supply arranged in the lamp body, and the high-power lamp further includes multiple LED light source assemblies, a top ring, a top light source board, and a ring mask. The lamp cap is connected with a narrow mouth portion of the lamp body, the top light source board is mounted on the top of the top ring, and the ring mask is covered outside the top light source board and connected to the top of the top ring. When the number of the LED light source assembly is one, the top end of the wide mouth portion of the lamp body is connected to the bottom of the LED light source assembly. The top ring is connected to the top of the LED light source assembly. The socket assembly in the LED light source assembly is electrically connected with the driving power supply in a plug-in mode. The pin assembly in the LED light source assembly is electrically connected with the top light source board in a plug-in mode. Multiple ventilation holes are uniformly provided in the bottom of the wide mouth portion of the lamp body, and walls of the wide mouth portion of the lamp body and the top ring in a circumferential direction thereof to form a chimney effect to achieve heat dissipation. When the number of LED light source assemblies is multiple, two adjacent LED light source assemblies are connected by a connecting ring. The top end of the wide mouth portion of the lamp body is connected with the bottom of the bottommost LED light source assembly. The top ring is connected to the top of the topmost LED light source assembly. The socket assembly in the bottommost LED light source assembly is electrically connected to the driving power supply in a plug-in mode. The pin assembly in the topmost LED light source assembly is electrically connected to the top light source board in a plug-in mode. The two adjacent LED light source assemblies are electrically connected by inserting the pins of the pin assemblies into the jacks of the socket assembly. Multiple ventilation holes are uniformly provided in a bottom of the wide mouth portion of the lamp body, walls of the wide mouth portion of the lamp body, the connecting ring, and the top ring in a circumferential direction thereof to form a chimney effect to achieve heat dissipation, and dissipate the heat generated by the LED chips in the LED light source assembly, the LED chips in the top light source board, and the driving power supply. In the design, only one LED light source assembly may be provided, but the power of this kind of lamp will be relatively small. If the required power is more than 100 W, at least two or more LED light source assemblies are required.

The lamp body includes a power supply bin and a bin cover, the power supply bin has a horn structure, and a narrow mouth portion of the power supply bin is connected with the lamp cap. The ventilation holes are provided in the bottom and the wall of the wide mouth portion of the power supply bin, and the inner cavity of the wide mouth portion is coaxially provided with an inner ring. The outer wall of the inner ring and the inner wall of the wide mouth portion of the power supply bin are connected by a first connecting rib. Multiple first baffles are provided in the inner side of the wide mouth portion of the power supply bin in a circumferential direction of the power supply bin. A first slot for fixing the LED light source board in the LED light source assembly is formed between the first baffle and the top end of the inner wall of the wide mouth portion of the power supply bin. The inner ring is uniformly provided with air passing holes communicating with the ventilation holes in a circumferential direction of the inner ring. The inner ring is provided with an accommodating gap. The circuit board of the driving power supply is provided with a first flange. After the driving power supply is mounted in the inner cavity of the inner ring, the first flange is accommodated in the accommodating gap. The first flange is provided with a power plug pin for inserting into the jack of the socket assembly. Heat dissipation through holes are provided in the top and wall of the bin cover, and a hollow connecting protrusion with a screw fixing pillar is provided on the top of the bin cover. When the number of the LED light source assembly is one, the screw fixing pillar on the hollow connecting protrusion is connected with the top ring. When the number of the LED light source assembly is multiple, the screw fixing pillar on the hollow connecting protrusion is connected with the connecting ring. After the bin cover is fixedly connected with the inner ring, the power plug pin is exposed outside the bin cover.

A central cylinder with a counterbore pillar is coaxially arranged in the connecting ring, and the central cylinder extends downward. The top of the outer wall of the central cylinder is connected with the inner wall of the connecting ring through a second connecting rib. Multiple second baffles are provided on the inner side of the connecting ring in a circumferential direction of the connecting ring. Second slots for fixing the LED light source board in the LED light source assembly are formed between the second baffles and the top end of the inner wall of the connecting ring and between the second baffles and the bottom end of the inner wall of the connecting ring. Multiple connecting pillars with screw holes are uniformly provided on the top of the central cylinder in a circumferential direction of the central cylinder, and the positions of the connecting pillars with screw holes and the counterbore pillars on the central cylinder are staggered. The counterbore pillar on the central cylinder in the bottommost connecting ring is connected with the screw fixing pillar on the hollow connecting protrusion. The connecting pillars with screw holes in the topmost connecting ring are connected with the top ring. The two adjacent connecting rings are connected with each other through the connecting pillar with screw holes and the counterbore pillar on the central cylinder.

A hollow lower boss with a screw hole pillar is coaxially arranged in a lower part of the top ring. The outer wall of the hollow lower boss and the inner wall of the top ring are connected through a third connecting rib. The hollow lower boss and the third connecting rib enclose a pit used for mounting the driving power supply. Multiple third baffles are provided on the inner side of the top ring in a circumferential direction of the top ring. Third slots for fixing the LED light source board in the LED light source assembly are formed between the third baffles and the bottom end of the inner wall of the top ring. When the number of the LED light source assembly is one, the screw hole pillar on the hollow lower boss is connected with the screw fixing pillar on the hollow connecting protrusion. When the number of the LED light source assembly is multiple, the screw hole pillar on the hollow lower boss is connected to the connecting pillar with screw holes. A positioning protrusion is provided on the horizontal surface of the third connecting rib. A positioning gap matched with the positioning protrusion is provided on a periphery of the top light source board. Buckles are uniformly provided on the top of the top ring in a circumferential direction of the top ring. Clamping slots for clamping with the buckles are uniformly provided on the periphery of the ring mask. The top light source board is provided with a second flange, and the second flange is provided with a plug jack for inserting the pin of the pin assembly.

A second current limiting device is arranged on the surface of the top light source board, and the second current limiting device is connected in series with the LED chip in the top light source board. The surface of the top light source board is covered with a second protective layer. Here, after the first current limiting device and the second current limiting device are arranged, the current of the LED light source assembly and the top light source board at different positions can be adjusted by the driving power supply, so as to control the power of the LED light source assembly and the top light source board at different positions to ensure the normal operation of the LED light source assembly and the top light source board. The arrangement of the second protective layer can increase the insulation of the top light source board, complies with safety regulations, and prevents the risk of electric shock.

Compared with the prior art, the following advantages are provided according to the present application.

1) After the LED light source board is rolled into a cylindrical shape, two ends of the LED light source board are respectively connected to the two sides of the electric connector, and the pin assembly is electrically connected to an electrode close to the pin assembly, and the socket assembly is electrically connected to the other electrode close to the socket assembly. Since the LED light source assembly with this structure has a large and thin area of the cylindrical LED light source board, the heat generated by the LED chips in the LED light source board can be quickly transferred to the surface of the LED light source board and dissipated into the air. Meanwhile, because the LED light source board is cylindrical, which is beneficial to air flow and can quickly take away the heat generated by the LED chip, the LED light source assembly with this structure does not need a heat sink with large volume and heavy weight. The heat conduction and cylindrical structure of the LED light source board can effectively solve the heat dissipation problem of the LED light source assembly, and avoid the increase of volume, weight, and price caused by the heat sink.
2) One end of the electric connector has a pin assembly and another end of the electric connector has a socket assembly. In this way, when multiple LED light source assemblies are combined, no additional wire welding is required, and the electric connector can be directly plugged, which is beneficial to the whole lamp assembly, thereby improving the assembly efficiency of the whole lamp.
3) In the high-power lamp, in addition to multiple LED light source assemblies, a top light source board is also set on the top to increase the light-emitting area, thereby making the light-emitting angle larger.

4) A first protective layer is covered on the surface of the LED light source assembly, and a second protective layer is covered on the surface of the top light source board, which increases the insulation of the LED light source assembly and the top light source board, complies the safety requirements, and prevents the risk of electric shock.

5) A first current limiting device is arranged on the electric connecting board and a second current limiting device is arranged on the top light source board, the current of the LED light source assembly and the top light source board at different positions can be adjusted by the driving power supply, so as to control the power of the LED light source assembly and the top light source board at different positions to ensure the normal operation of the LED light source assembly and the top light source board.

DETAILED DESCRIPTION

The present application will be further described in detail below in conjunction with the embodiments of the drawings.

First Embodiment

Figure 1:
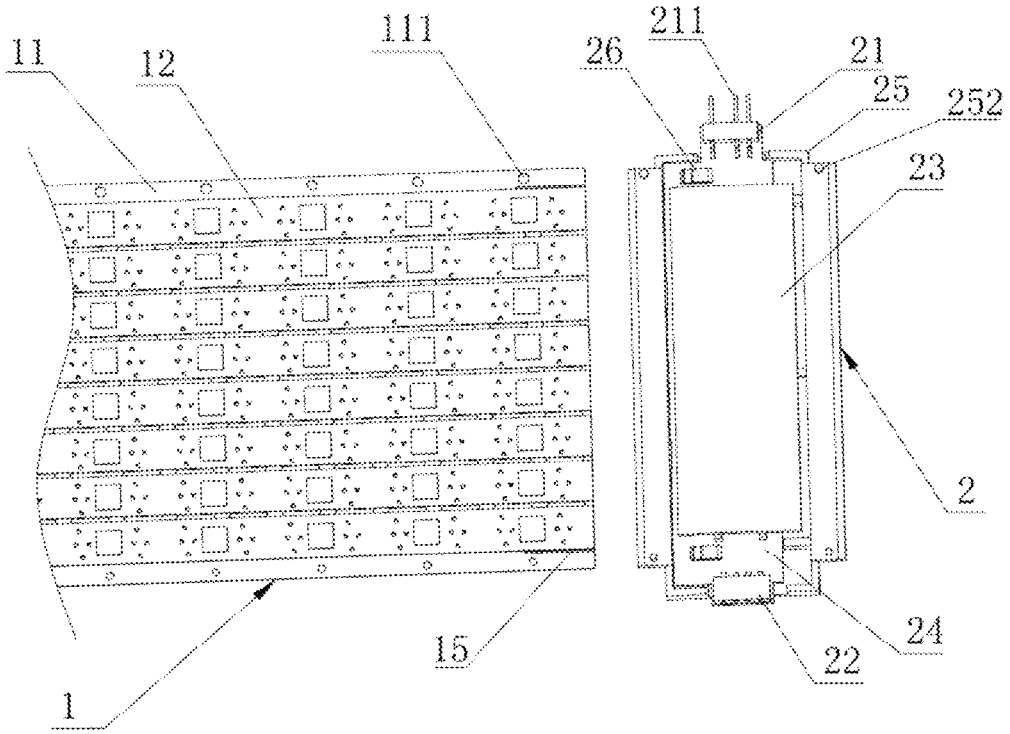
FIG. 1 is a schematic view showing the structure of an LED light source assembly according to the present application when an LED light source board and an electric connector are not assembled together.
Figure 2:
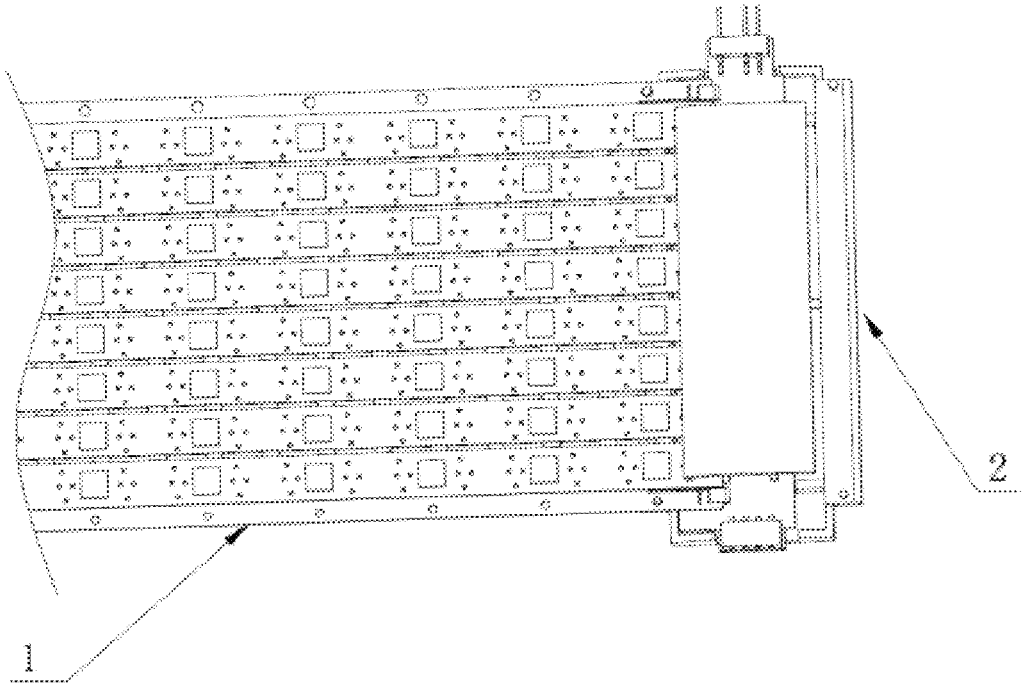
FIG. 2 is a schematic view showing the structure of an LED light source assembly in an expanded state according to the present application.
Figure 3:
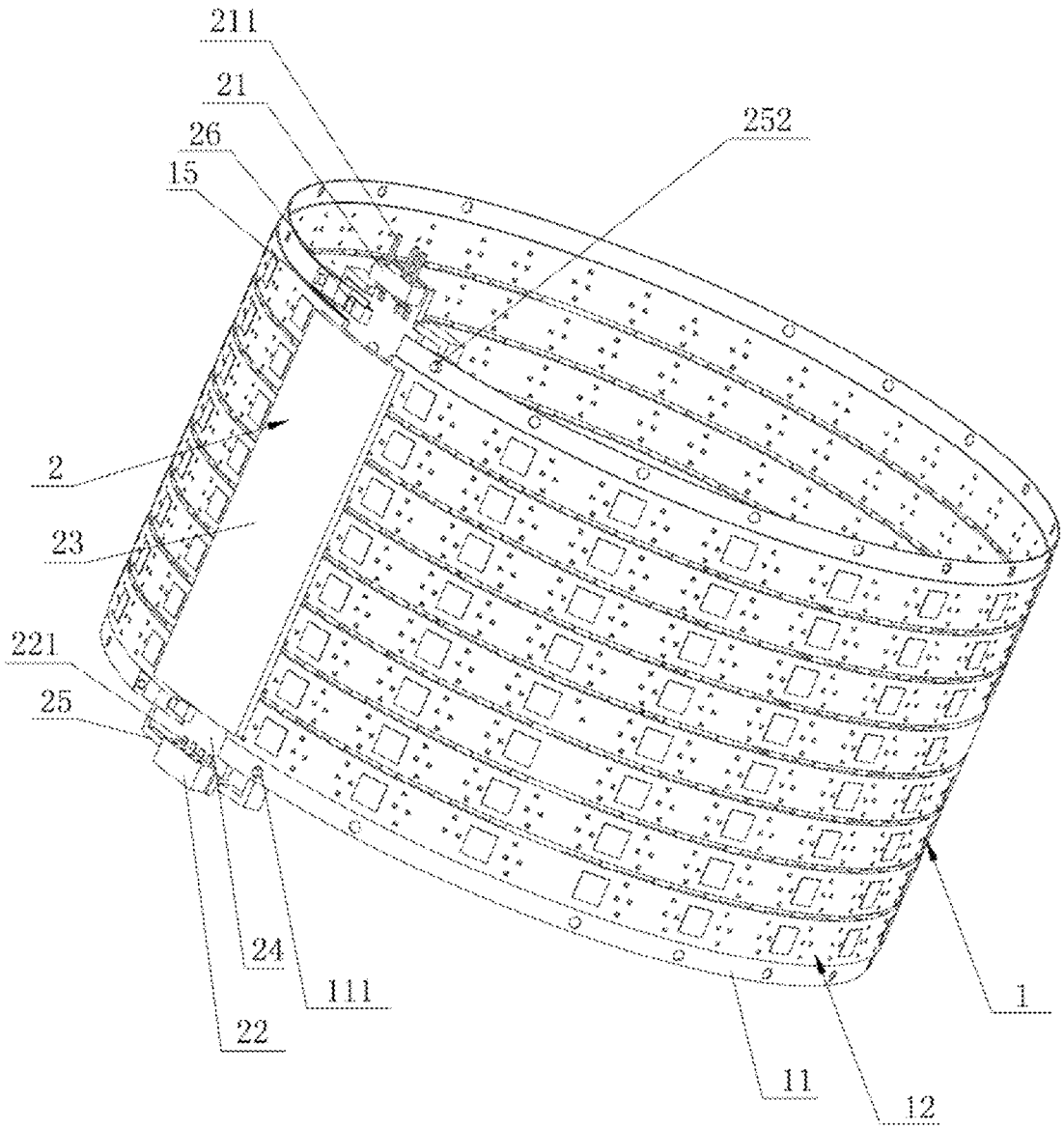
FIG. 3 is a schematic view showing the three-dimensional structure of an LED light source assembly according to the present application.
Figure 4:
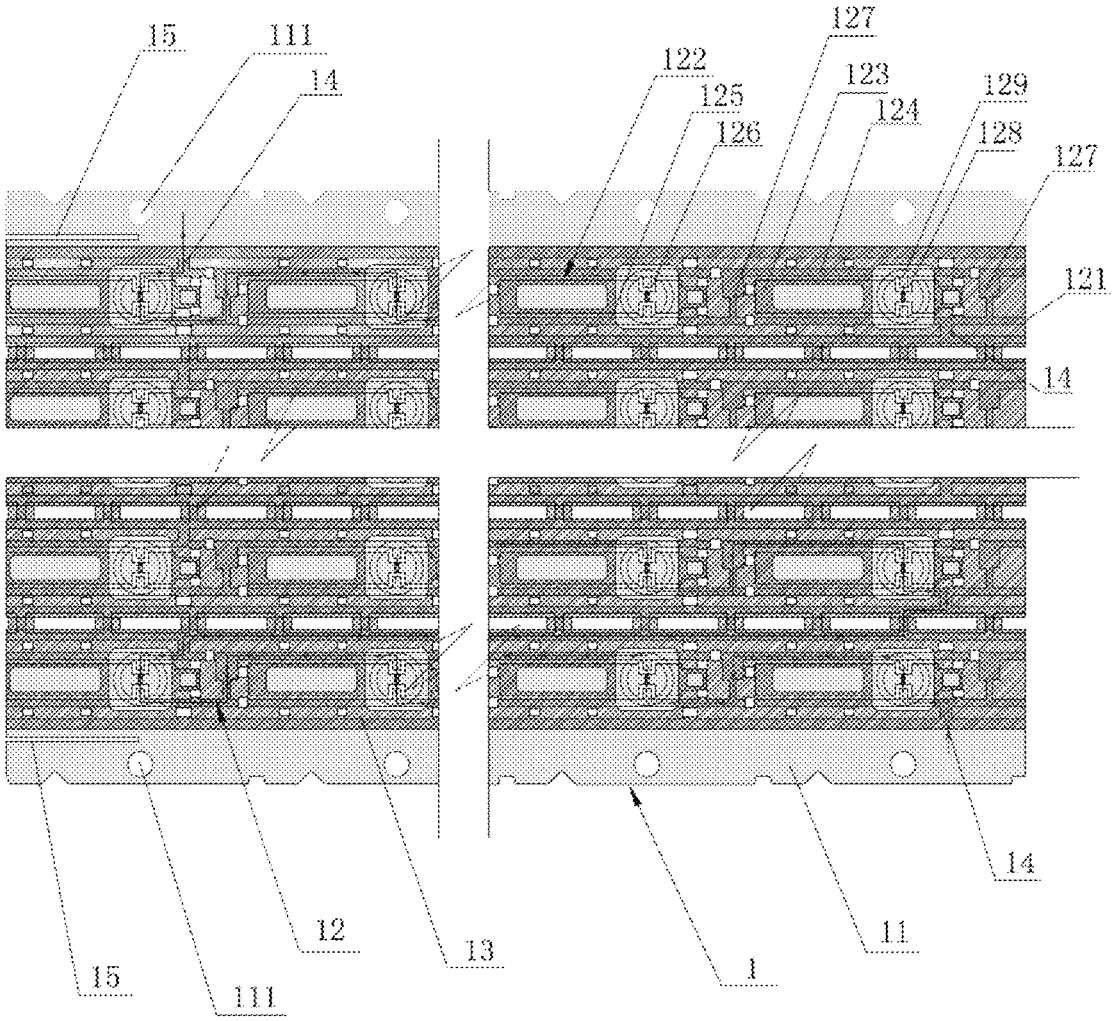
FIG. 4 is a schematic view showing the planar structure of an LED light source board (LED chips in full series) in an LED light source assembly according to the present application.
Figure 5:
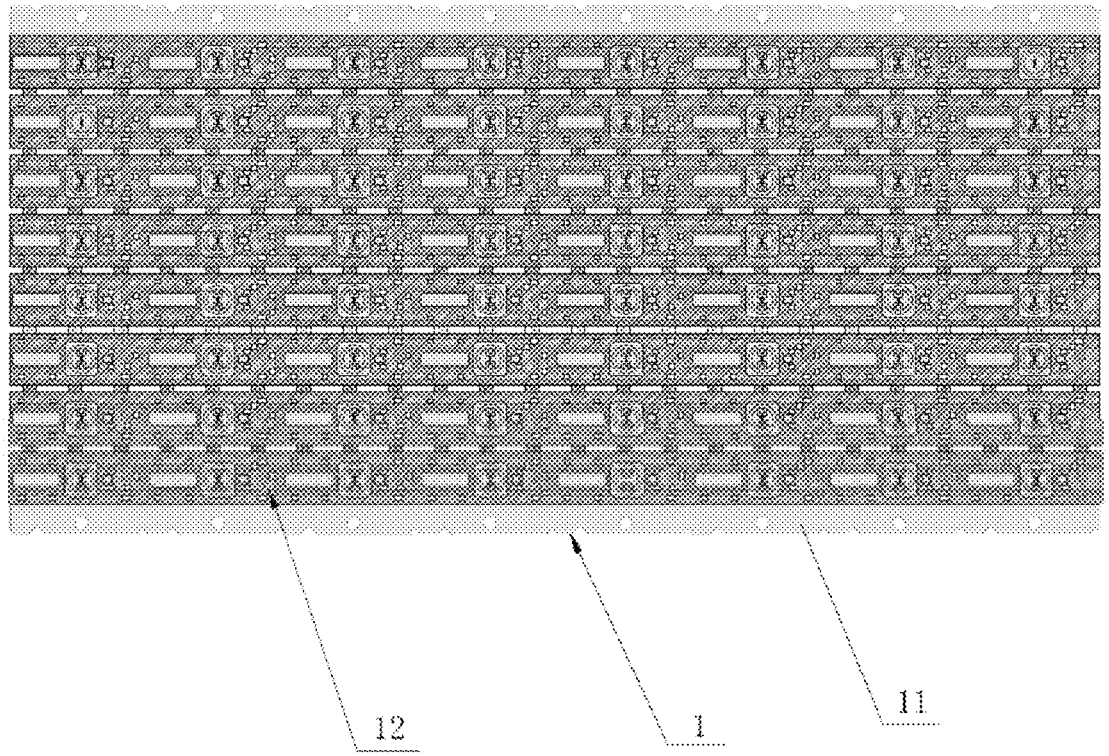
FIG. 5 is a schematic view showing the planar structure of an LED light source board (the LED chips are connected in parallel and then connected in series) in an LED light source assembly according to the present application.
Figure 6:
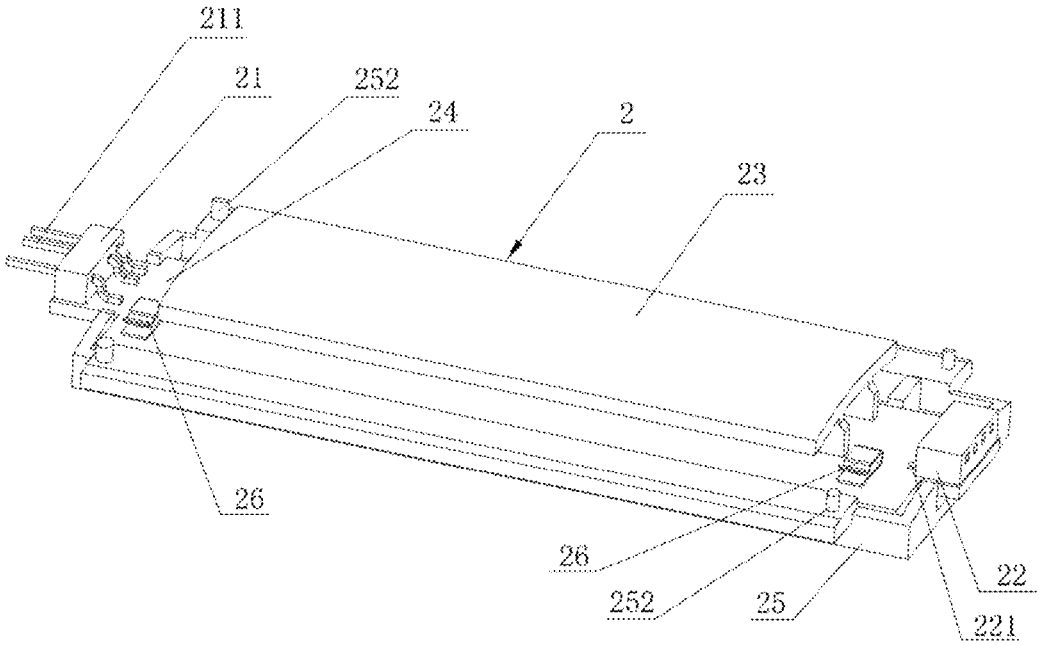
FIG. 6 is a schematic view showing the three-dimensional structure of an electric connector in an LED light source assembly according to the present application.
Figure 7:
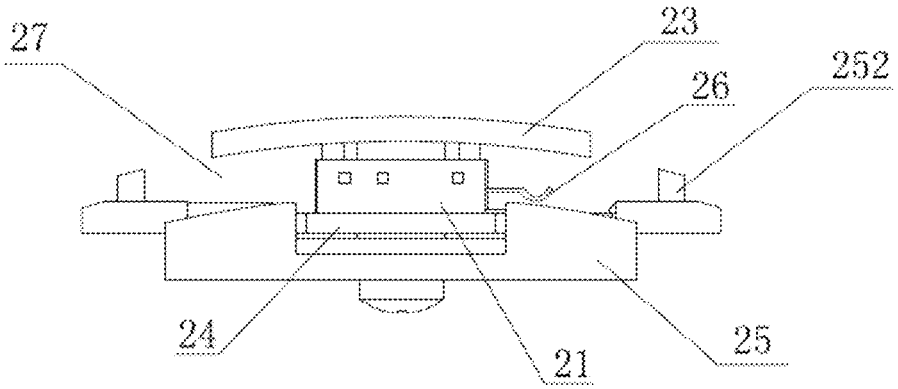
FIG. 7 is a side view of an electric connector in an LED light source assembly according to the present application.
Figure 8:
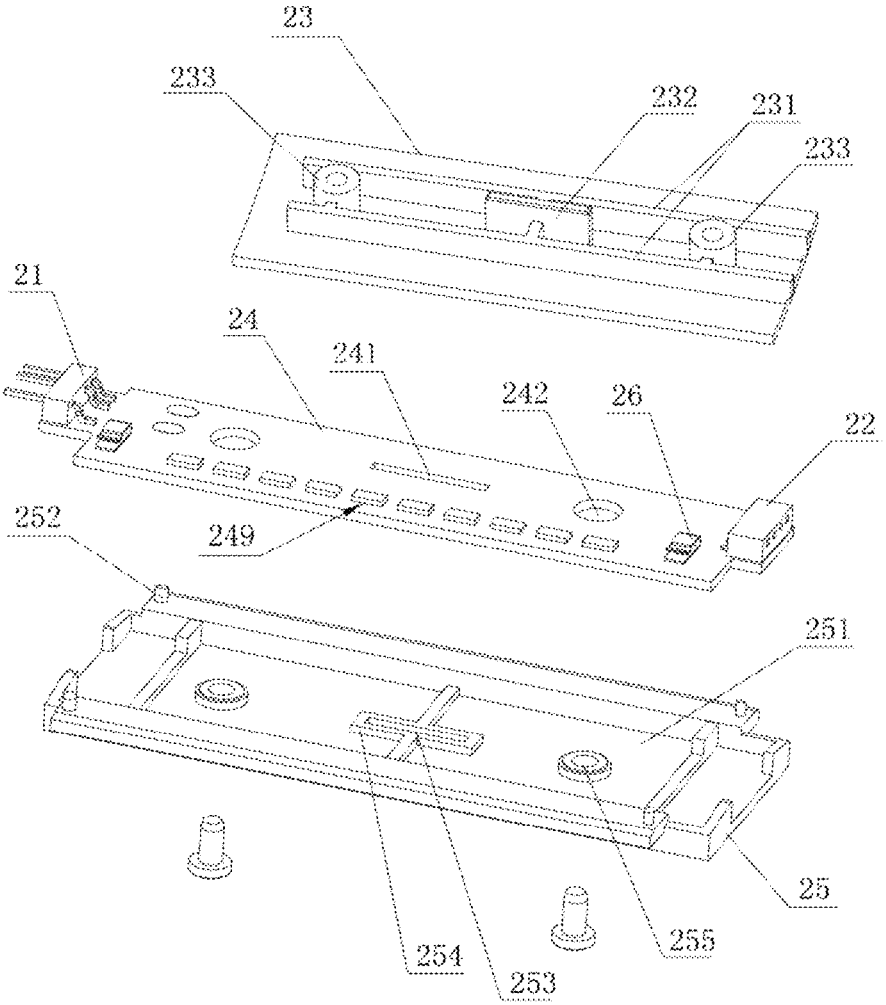
FIG. 8 is an exploded view showing the structure of an electric connector in an LED light source assembly according to the present application.

The LED light source assembly is provided according to this embodiment, as shown in FIGS. 1 to 8, which includes an LED light source board 1 and an electric connector 2. The LED light source board 1 has a strip structure. The LED light source board 1 is provided with two electrodes 11 which are arranged along a longitudinal direction of the LED light source board 1 and parallel to each other. One end of the electric connector 2 is provided with a pin assembly 21 and another end of the electric connector 2 is provided with a socket assembly 22, so that one end of the LED light source board 1 in the longitudinal direction of the LED light source board 1 is connected to one side of the electric connector 2. After the LED light source board 1 is rolled, another end of the LED light source board 1 in the longitudinal direction of the LED light source board 1 is connected to another side of the electric connector 2, and the pin assembly 21 is electrically connected to one of the two electrodes 11 close to the pin assembly 21, and the socket assembly 22 is electrically connected to the other electrode 11 close to the socket assembly 22 to form an LED light source assembly with a cylindrical structure as a whole.

In this embodiment, the LED light source board 1 includes two electrodes 11 and eight LED light bars 12 arranged along the longitudinal direction of the LED light source board 1 and arranged in parallel between the two electrodes 11. One of the two electrodes 11 and the LED light bar 12 closest to the electrode 11, two adjacent LED light bars 12, and the other electrode 11 and the LED light bar 12 closest to the electrode 11 are all connected into a whole through plastic connectors 13. One of the two electrodes 11 and the LED light bar 12 closest to the electrode 11, two adjacent LED light bars 12, and the other electrode 11 and the LED light bar 12 closest to the electrode 11 are all electrically connected through electrical connecting wires 14.

In this embodiment, the electric connector 2 includes an upper cover 23, an electric connecting board 24, a box-shaped lower cover 25, the pin assembly 21 and the socket assembly 22. The pin assembly 21 is arranged on one end of the front of the electric connecting board 24, and the socket assembly 22 is arranged on another end of the front of the electric connecting board 24. Plug terminals 26 for plugging the two electrodes 11 are symmetrically provided at the two ends of one side of the front of the electric connecting board 24, and the plug ports of the plug terminals 26 face the outer side of the electric connecting board 24. The pin 211 in the pin assembly 21 is electrically connected to one of the plug terminals 26 close to the pin 211 through a circuit of the electric connecting board 24, and the connecting guide pin 221 in the socket assembly 22 is electrically connected to another plug terminal 26 close to the connecting guide pin 221 through the circuit of the electric connecting board 24. The lower cover 25 is provided with an accommodating cavity 251, and the pin assembly 21 and the socket assembly 22 are exposed outside the lower cover 25 after the electric connecting board 24 is placed in the accommodating cavity 251. The upper cover 23 is covered on the electric connecting board 24, and after the upper cover 23 and the lower cover 25 are matched and connected, insertion ports 27 for inserting ends in the longitudinal direction of the LED light source board 1 are respectively formed in two sides between the upper cover 23 and the lower cover 25 longitudinal. Here, the size of the upper cover 23 is required to be slightly smaller than that of the lower cover 25 in design, so that the plug terminals 26 are exposed outside the upper cover 23, that is, outside the insertion ports 27. After the ends of the longitudinal direction of the LED light source board 1 insert into the insertion ports 27, the ends are upturned to abut against the inner side of the upper cover 23.

In this embodiment, positioning holes 111 are respectively provided at two ends of each electrode 11 in a longitudinal direction of the electrode, and a notch 15 is formed by cutting one end of the plastic connector 13 connecting the electrode 11 and the LED light bar 12 in the longitudinal direction of the plastic connector. The notch 15 extends to the closest positioning hole 111. Two positioning pillars 252 are respectively arranged on two sides of the lower cover 25, and the positioning pillars 252 are respectively positioned outside the insertion port 27, and each of the positioning pillars 252 is matched with the corresponding positioning hole 111 to achieve positioning. One end of the LED light source board 1 with the notch 15 is inserted into one of the insertion ports 27 on the same side as the plug terminals 26, while another end of the LED light source board 1 is inserted into the other insertion port 27, and parts of the electrodes 11 separated by the notch are inserted into the plug terminals 26. Here, the positioning connection between the LED light source board 1 and the electric connector 2 is achieved by the matching of the positioning hole 111 and the positioning pillar 252. In order to facilitate the positioning hole 111 to be sleeved outside the positioning pillar 252, the top end surface of the positioning pillar 252 is designed to be a downward slope from the inside to the outside. The arrangement of the notch 15 makes the corresponding part of the electrodes have good elasticity, so that the part of the electrodes can be smoothly inserted into the plug terminals 26, while ensuring the reliability of the electrical connection.

In this embodiment, two mounting strips 231 are provided on the inner side of the upper cover 23 in the longitudinal direction of the upper cover 23, a positioning strip 232 is provided between the middle positions of the two mounting strips 231, and a mounting pillar 233 with a screw hole is arranged at each edge position between the two mounting strips 231. The electric connecting board 24 is provided with positioning through holes 241 for the positioning strips 232 to pass through, and mounting holes 242 for the mounting pillars 233 to pass through. A positioning seat 254 matched with the positioning strip 232 and provided with a positioning groove 253 is provided at the bottom of the accommodating cavity 251. Screw penetration holes 255 matched with the mounting pillars 233 are provided at the bottom of the accommodating cavity 251. After the upper cover 23 and the lower cover 25 are matched and connected, the bottoms of the two mounting strips 231 abut against the front of the electric connecting board 24 so that the insertion ports 27 are respectively formed on both sides between the upper cover 23 and the lower cover 25. Here, two mounting strips 231 are used to abut against the front of the electric connecting board 24 to make the upper cover 23 and the lower cover 25 have a larger distance to form the insertion ports 27. The matching of the positioning strip 232 with the positioning through hole 241 and the positioning groove 253 achieves the positioning connection among the upper cover 23, the electric connecting board 24 and the lower cover 25, so that the upper cover 23, the electric connecting board 24 and the lower cover 25 can be quickly mounted together. The arrangement of the mounting pillar 233, the mounting holes 242, and the screw penetration holes 255 allows the upper cover 23, the electric connecting board 24, and the lower cover 25 to be connected as a whole by screws. The upper cover 23, the electric connecting board 24 and the lower cover 25 can be fixedly connected by snap connection in actual design.

In this embodiment, the LED light bar 12 includes a metal substrate 121, and multiple LED units 122 are sequentially processed on the metal substrate 121 in a longitudinal direction of the metal substrate 121. Each LED unit 122 includes a heat sink 123, an upper lead section 124 located above the heat sink 123, a lower lead section 125 located below the heat sink 123 and an LED chip 126. The heat sink 123 is not connected to the upper lead section 124 and the lower lead section 125, and two ends of the upper lead section 124 are correspondingly connected to the two ends of the lower lead section 125 through a connecting bridge 127. The two ends of the heat sink 123 are wide and the middle part of the heat sink 123 is narrow to form an inner recess 128. A protrusion 129 that protrudes in a direction of the heat sink 123 and is embedded in the inner recess 128 is respectively provided on the middle parts of the upper lead section 124 and the lower lead section 125. The LED chip 126 is mounted on the narrow area in the middle part of the heat sink 123, and the two chip electrodes of the LED chip 126 are respectively electrically connected to the two protrusions 129 through wires. The LED chips 126 are coated with fluorescent glue (not shown in the figure), and all the LED chips are connected in series or in series and parallel by punching the connecting bridge 127. Here, the heat sink 123, the upper lead section 124 and the lower lead section 125 are formed directly on the metal substrate through the existing punching process. During processing, the two ends of the upper lead section 124 are connected to the two ends of the lower lead section 125 by a connecting bridge 127. When designing the circuit, the connecting bridge 127 is punched according to the connection requirements of all the LED chips 126 to make all the LED chips 126 connected in series or in series and parallel.

In this embodiment, the surface of the LED light bar 12 and the surface of the electrode 11 are covered with a first protective layer (not shown in the figure). The arrangement of the first protective layer can increase the insulation of the LED light bar and the electrode, complies with safety regulations, and prevents the risk of electric shock. The first protective layer may be a transparent or translucent film or glue, or other protection methods may be used.

As described above, both the pin assembly 21 and the socket assembly 22 adopt the prior art. The plastic connector 13 is formed by filling plastic. The upper cover 23 and the lower cover 25 are both made of insulating materials. The electric connecting board 24 may be a PCB board, and the circuit on the PCB board may be designed according to actual requirements. The plug terminal 26 is a conductor, and the electrical connection is achieved after the electrode 11 is inserted into the plug terminal 26.

Second Embodiment

Figure 9:
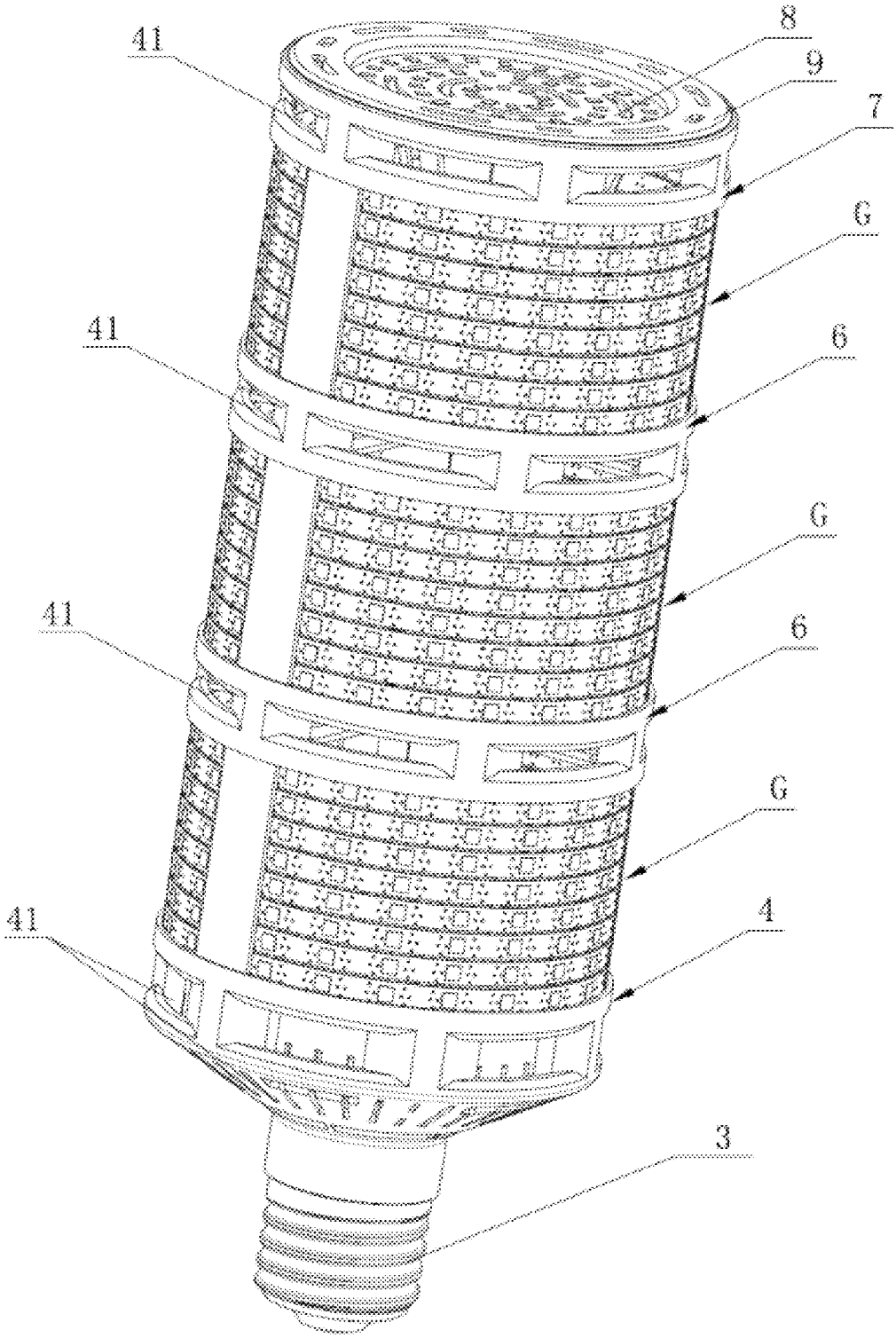
FIG. 9 is a schematic view showing the three-dimensional structure of a high-power lamp according to the present application.
Figure 10:
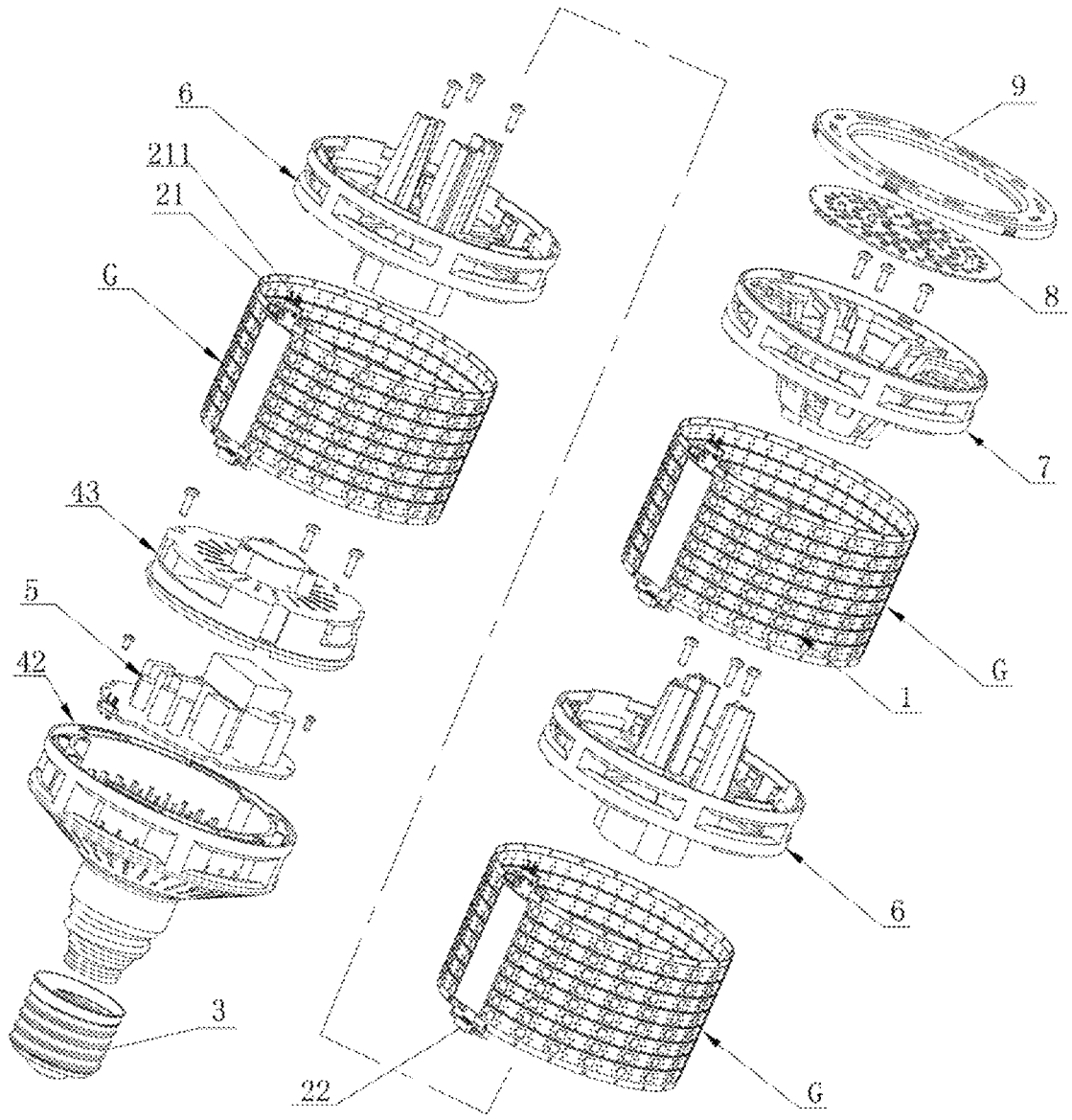
FIG. 10 is an exploded view showing the structure of a high-power lamp according to the present application.
Figure 11:
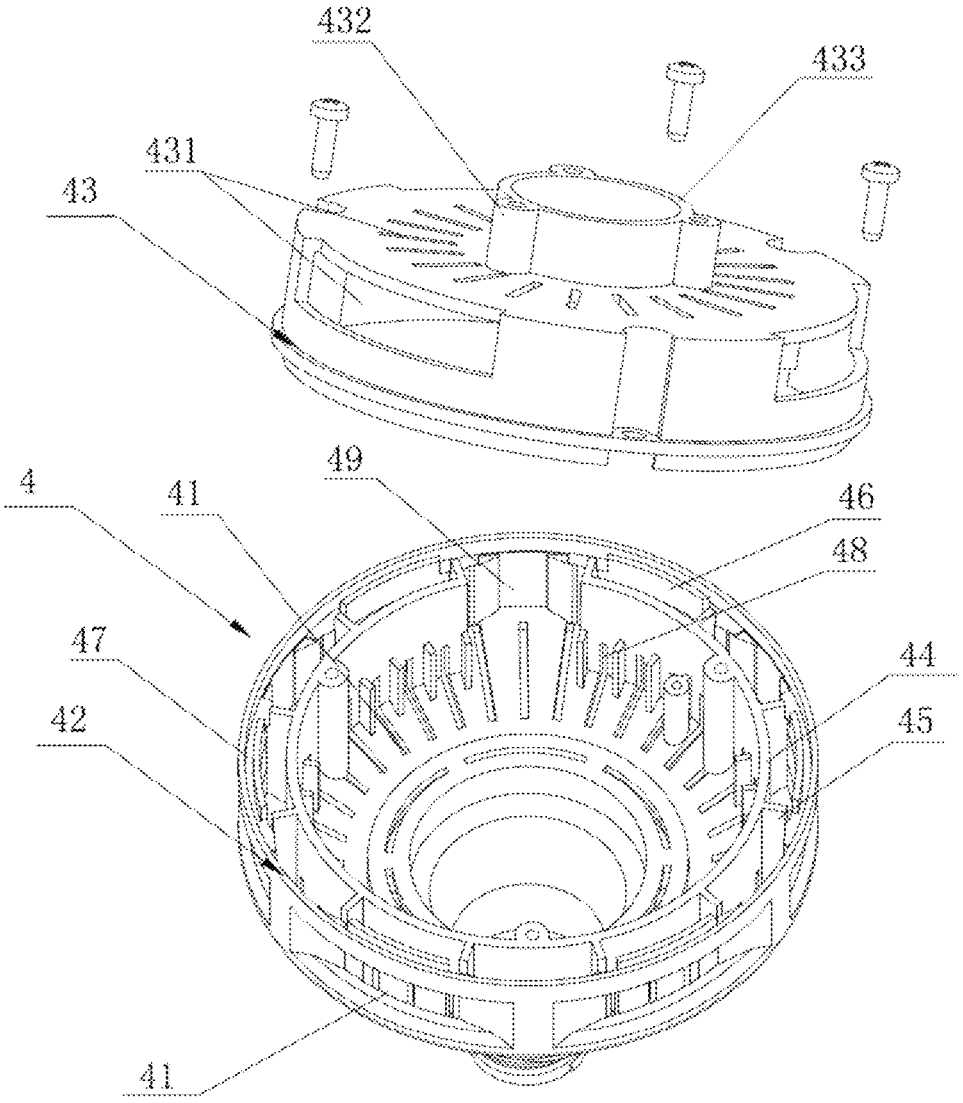
FIG. 11 is an exploded view showing the structure of a lamp body in a high-power lamp according to the present application.
Figure 12:
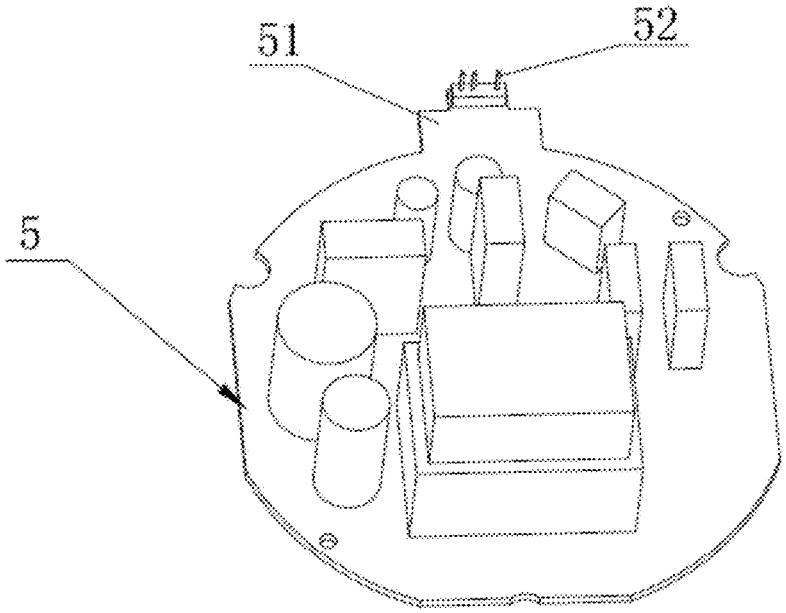
FIG. 12 is a schematic view showing the structure of a driving power supply in a high-power lamp according to the present application.
Figure 13:
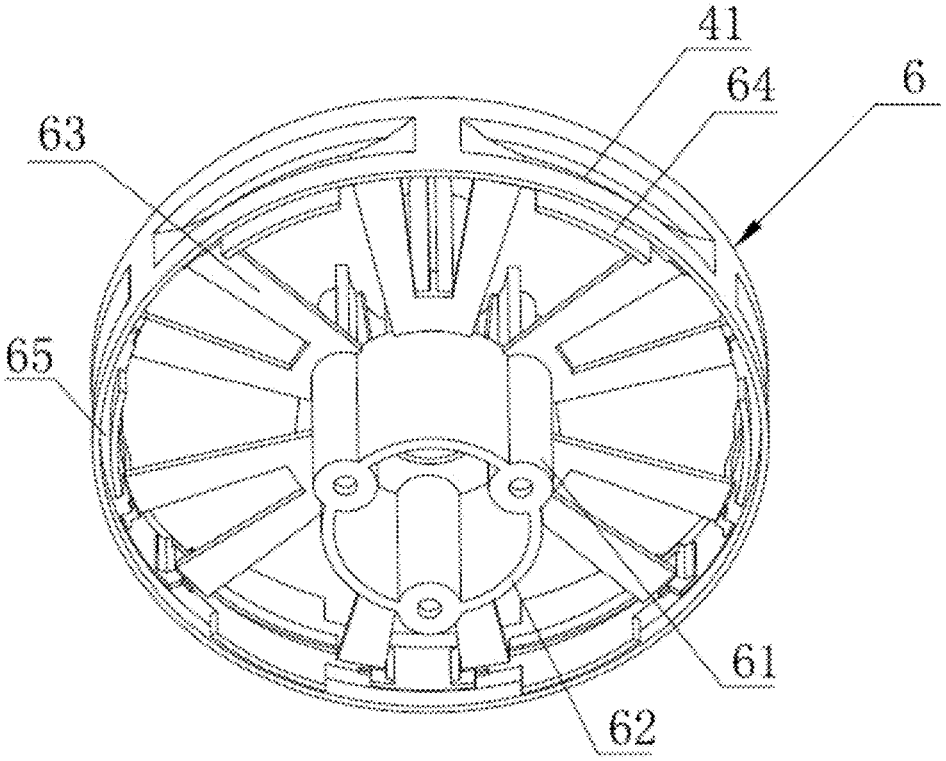
FIG. 13 is a first schematic view showing the structure of a connecting ring in a high-power lamp according to the present application.
Figure 14:
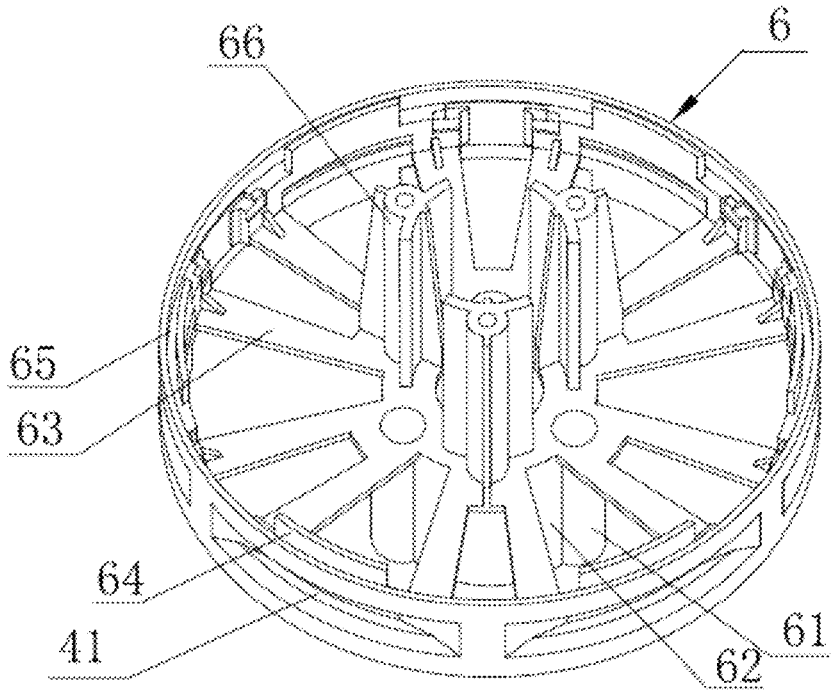
FIG. 14 is a second schematic view showing the structure of a connecting ring in a high-power lamp according to the present application.
Figure 15:
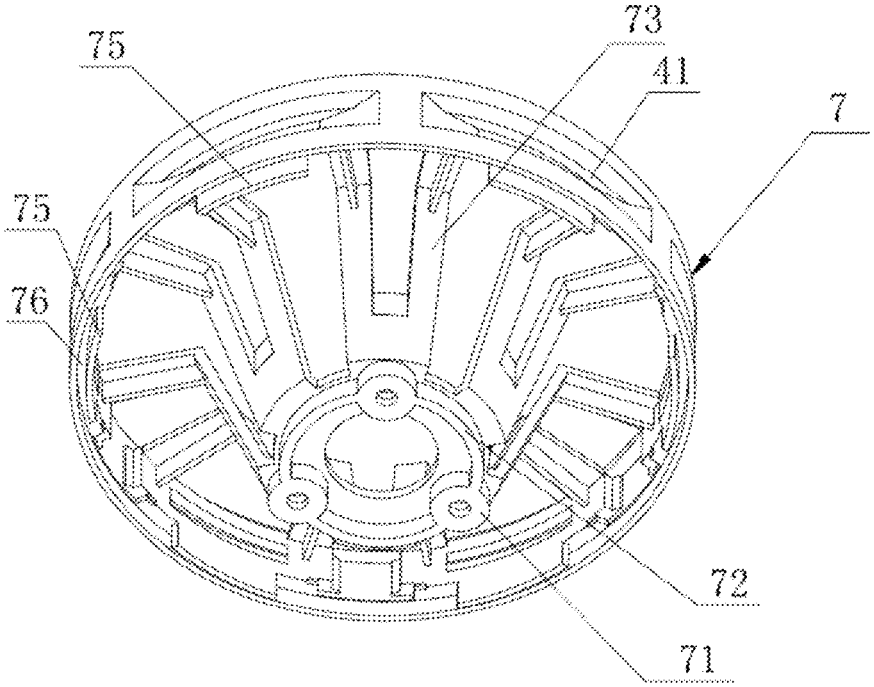
FIG. 15 is a first schematic view showing the structure of a top ring in a high-power lamp according to the present application.
Figure 16:
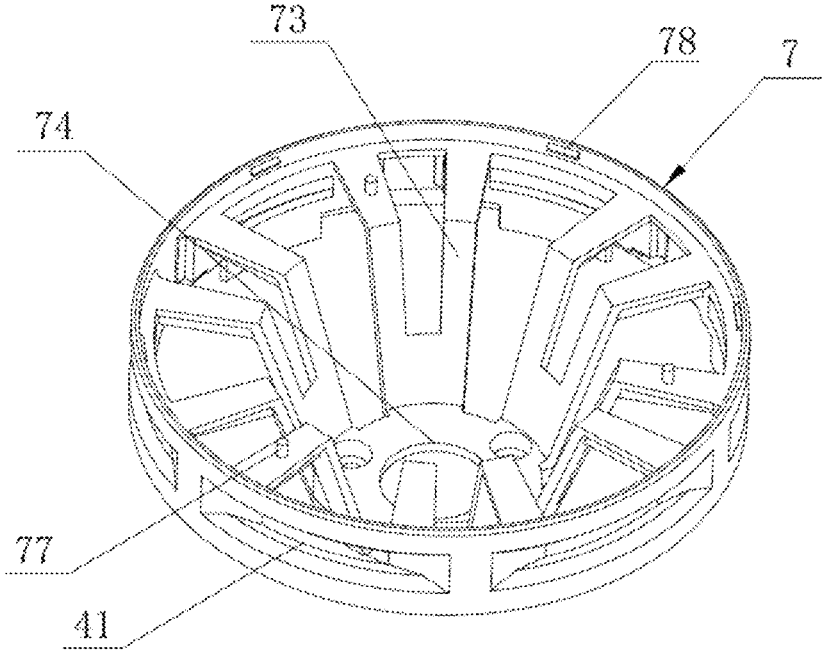
FIG. 16 is a second schematic view showing the structure of a top ring in a high-power lamp according to the present application.
Figure 17:
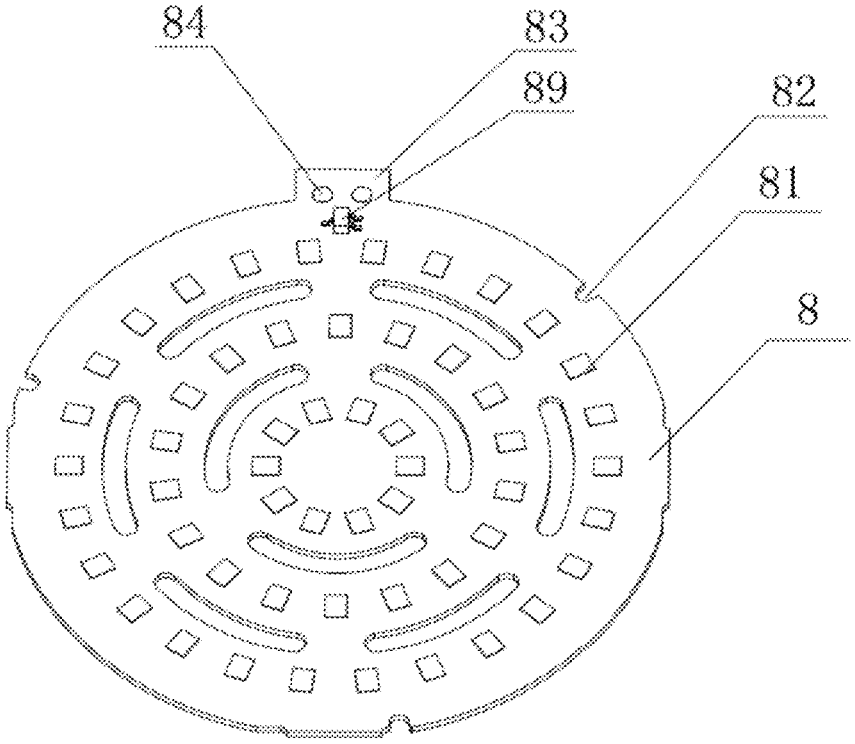
FIG. 17 is a schematic view showing the structure of a top light source board in a high-power lamp according to the present application.
Figure 18:
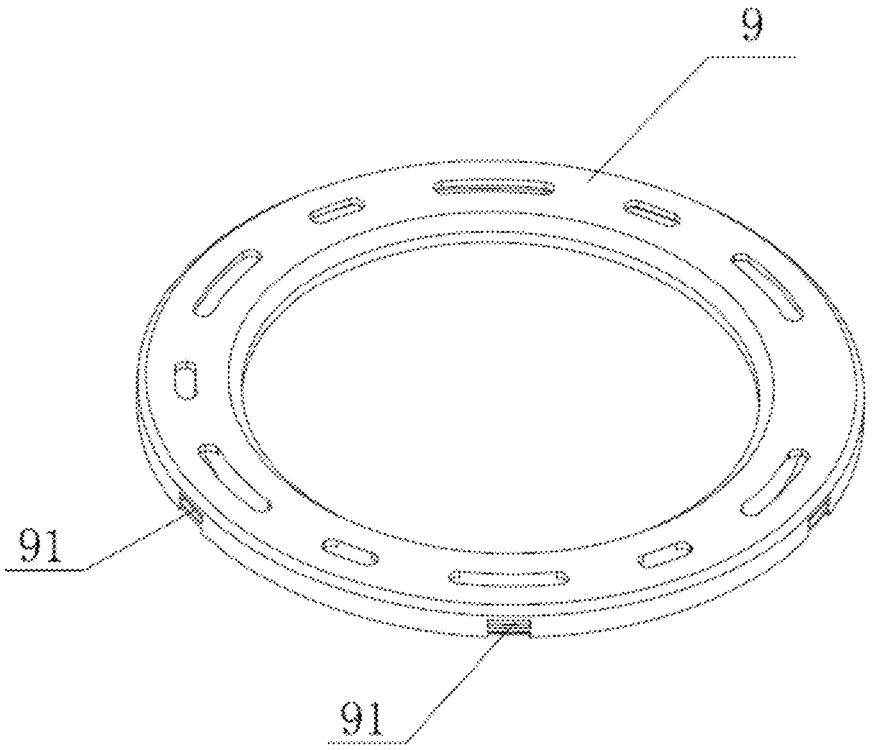
FIG. 18 is a schematic view showing the structure of a ring mask in a high-power lamp according to the present application.

A high-power lamp using the LED light source assembly of the first embodiment is provided according to this embodiment, as shown in FIGS. 9 to 18, which includes a lamp cap 3, a lamp body 4, a driving power supply 5 provided in the lamp body 4, three LED light source assemblies G, a top ring 7, a top light source board 8 and a ring mask 9. The lamp cap 3 is connected with the narrow mouth portion of the lamp body 4, the top light source board 1 is mounted on the top of the top ring 7, and the ring mask 9 is covered outside the top light source board 1 and connected to the top of the top ring 7. Two adjacent LED light source assemblies G are connected by a connecting ring 6. The top end of the wide mouth portion of the lamp body 4 is connected to the bottom of the LED light source assembly G. The top ring 7 is connected to the top of the LED light source assembly G. The socket assembly 22 in the bottommost LED light source assembly G and the driving power source 5 are electrically connected in a plug-in mode. The pin assembly 21 in the topmost LED light source assembly G is electrically connected to the top light source board 8 in a plug-in mode. The two adjacent LED light source assemblies G are electrically connected by inserting the pins 211 of the pin assemblies 21 into the jacks (not shown in the figure) of the socket assembly 22. Multiple ventilation holes 41 are uniformly provided at the bottom of the wide mouth portion of the lamp body 4, and walls of the wide mouth portion of the lamp body 4, the connecting ring 6, and the top ring 7 in the circumferential direction thereof to form a chimney effect to achieve heat dissipation, and to dissipate the heat generated by the LED chips 126 in the LED light source assembly, the LED chips in the top light source board 8, and the driving power supply 5.

In this embodiment, the lamp body 4 includes a power supply bin 42 and a bin cover 43, the power supply bin 42 has a horn structure, and the narrow mouth portion of the power supply bin 42 is connected with the lamp cap 3. The ventilation holes 41 are provided in the bottom and the wall of the wide mouth portion of the power supply bin 42, and the inner cavity of the wide mouth portion of the power supply bin 42 is coaxially provided with an inner ring 44. The outer wall of the inner ring 44 and the inner wall of the wide mouth portion of the power supply bin 42 are connected by a first connecting rib 45. Multiple first baffles 46 are provided in the inner side of the wide mouth portion of the power supply bin 42 in the circumferential direction of the power supply bin 42. A first slot 47 for fixing the LED light source board 1 in the LED light source assembly G is formed between the first baffle 46 and the top end of the inner wall of the wide mouth portion of the power supply bin 42. The inner ring 44 is uniformly provided with air passing holes 48 communicating with the ventilation holes 41 in the circumferential direction of the inner ring 44. The inner ring 44 is provided with an accommodating gap 49. The circuit board of the driving power supply 5 is provided with a first flange 51. After the driving power supply 5 is mounted in the inner cavity of the inner ring 44, the first flange 51 is accommodated in the accommodating gap 49. The first flange 51 is provided with a power plug pin 52 for inserting into the jack of the socket assembly 22. Heat dissipation through holes 431 are provided in the top and wall of the bin cover 43, and a hollow connecting protrusion 433 with a screw fixing pillar 432 is provided on the top of the bin cover 43. The screw fixing pillar 432 on the hollow connecting protrusion 433 is connected with the connecting ring 6. After the bin cover 43 is fixedly connected with the inner ring 44, the power plug pin 52 is exposed outside the bin cover 43.

In this embodiment, a central cylinder 62 with a counterbore pillar 61 is coaxially arranged in the connecting ring 6, and the central cylinder 62 extends downward. The top of the outer wall of the central cylinder 62 is connected with the inner wall of the connecting ring 6 through a second connecting rib 64. Multiple second baffles 64 are provided on the inner side of the connecting ring 6 in the circumferential direction of the connecting ring 6. Second slots 65 for fixing the LED light source board 1 in the LED light source assembly G are formed between the second baffle 64 and the top end of the inner wall of the connecting ring 6 and between the second baffle 64 and the bottom end of the inner wall of the connecting ring 6. Multiple connecting pillars 66 with screw holes are uniformly provided on the top of the central cylinder 62 in the circumferential direction of the central cylinder 62, and the positions of the connecting pillar 66 with screw holes and the counterbore pillars 61 on the central cylinder 62 are staggered. The counterbore pillar 61 on the central cylinder 62 in the bottommost connecting ring 6 is connected with the screw fixing pillar 432 on the hollow connecting protrusion 433. The connecting pillar 66 with screw holes in the topmost connecting ring 6 is connected with the top ring 7. The two adjacent connecting rings 6 are connected with each other through the connecting pillar 66 with screw holes and the counterbore pillar 61 on the central cylinder 62.

In this embodiment, a hollow lower boss 72 with a screw hole pillar 71 is coaxially arranged under the top ring 7. The outer wall of the hollow lower boss 72 and the inner wall of the top ring 7 are connected through a third connecting rib 73. The hollow lower boss 72 and the third connecting rib 73 enclose a pit 74 used for mounting the driving power supply 5. Multiple third baffles 75 are provided on the inner side of the top ring 7 in a circumferential direction of the top ring 7. Third slots 76 for fixing the LED light source board 1 in the LED light source assembly G are formed between the third baffles 75 and the bottom end of the inner wall of the top ring 7. The screw hole pillar 71 on the hollow lower boss 72 is connected to the connecting pillar 66 with screw holes. A positioning protrusion 77 is provided on the horizontal surface of the third connecting rib 73. A positioning gap 82 matched with the positioning protrusion 77 is provided on a periphery of the top light source board 8. Buckles 78 are uniformly provided on the top of the top ring 7 in the circumferential direction of the top ring 7. Clamping slots 91 for clamping with the buckles 78 are uniformly provided on a periphery of the ring mask 9. The top light source board 8 is provided with a second flange 83, and the second flange 83 is provided with a plug jack 84 for inserting the pin 211 of the pin assembly 21.

In this embodiment, the surface of the top light source board 8 is covered with a second protective layer (not shown in the figure). The arrangement of the second protective layer can increase the insulation of the top light source board 8, complies with the safety regulations, and prevents the risk of electric shock. The second protective layer may be a transparent or translucent film or glue, or other protection methods may be used.

When the number of the LED light source assembly G is one, the top end of the wide mouth portion of the lamp body 4 is connected to the bottom of the LED light source assembly G. The top ring 7 is connected to the top of the LED light source assembly G. The socket assembly 22 in the LED light source assembly G is electrically connected with the driving power supply 5 in a plug-in mode. The pin assembly 21 in the LED light source assembly G is electrically connected with the top light source board 8 in a plug-in mode. Multiple ventilation holes 41 are uniformly provided on the bottom of the wide mouth portion of the lamp body 4, the walls of the wide mouth portion of the lamp body 4, and the top ring 7 in the circumferential direction thereof to form a chimney effect to achieve heat dissipation. The screw hole pillar 71 on the hollow lower boss 72 is connected with the screw fixing pillar 432 on the hollow connecting protrusion 433.

Third Embodiment

A high-power lamp using the LED light source assembly of the first embodiment is provided in this embodiment, the structure of which is basically the same as that of the high-power lamp of the second embodiment. The only difference is that: each electric connector 2 is provided with a first current limiting device 249 on the front of the electric connecting board 24. The first current limiting device 249 is connected in series with the LED chip 126 in the LED light source board 1 electrically connected to the electric connecting board 24. A second current limiting device 89 is provided on the surface of the top light source board 8. The second current limiting device 89 is connected in series with the LED chip 81 in the top light source board 8. After the first current limiting device 249 and the second current limiting device 89 are provided, the current of the LED light source assembly G and the top light source board 8 at different positions can be adjusted by the driving power supply 5, so as to control the power of the LED light source assembly G and the top light source board 8 at different positions and ensure the normal operation of the LED light source assembly G and the top light source board 8.

In this embodiment, the first current limiting device 249 and the second current limiting device 89 include, but are not limited to, a resistor, a constant current tube, and a transistor. The current limiting values of the first current limiting device 249 and the second current limiting device 89 may be designed to be the same or different according to the requirements of different mounting environments. In an embodiment, when the above high-power lamp with three LED light source assemblies G is mounted on a lamp holder with a lamp shade, the heat dissipation effect of the LED light source assembly G closer to the lamp shade is worse due to the obstruction of the lamp shade. Therefore, in order to prevent the LED light source assembly G from failing during the long-term lighting process, the current limiting value of the first current limiting device 249 on the LED light source assembly G closest to the lamp shade may be set smaller to reduce the power of the LED light source assembly G. The current limiting value of the first current limiting device 249 on the LED light source assembly G far away from the lampshade may be set larger to increases the power of the LED light source assembly G, thus ensuring that the heat dissipation effect of the LED light source assembly G on each layer is similar and prolonging the service life of the high-power lamp. In another example, when the above high-power lamp with three LED light source assemblies G is mounted on a lamp holder without a lamp shade. Since the above high-power lamp is in direct contact with the external environment, the current limiting values of the first current limiting devices 249 on the LED light source assemblies G may be set to the same.

The invention claimed is:

1. An LED light source assembly, comprising:

a rolled LED light source board, and an electric connector, wherein the LED light source board is provided with two electrodes which are arranged in a longitudinal direction of the LED light source board and parallel to each other, and one end of the electric connector is provided with a pin assembly and another end of the electric connector is provided with a socket assembly, one end of the LED light source board in the longitudinal direction of the LED light source board is connected to one side of the electric connector; and another end of the rolled LED light source board in the longitudinal direction of the LED light source board is connected to another side of the electric connector, and the pin assembly is electrically connected to one of the two electrodes close to the pin assembly, and the socket assembly is electrically connected to the other electrode close to the socket assembly to form the LED light source assembly with a cylindrical structure as a whole.

2. The LED light source assembly according to claim 1, wherein, the LED light source board comprises the two electrodes and a plurality of LED light bars arranged along the longitudinal direction of the LED light source board and arranged in parallel between the two electrodes, and one of the two electrodes and the LED light bar closest to the electrode, two adjacent LED light bars, and the other electrode and the LED light bar closest to the electrode are all connected into a whole through plastic connectors; and one of the two electrodes and the LED light bar closest to the electrode, two adjacent LED light bars, the other electrode and the LED light bar closest to the electrode are all electrically connected through electrical connecting wires.

3. The LED light source assembly according to claim 2, wherein, the electric connector comprises an upper cover, an electric connecting board, a box-shaped lower cover, the pin assembly and the socket assembly; and the pin assembly is arranged on one end of a front of the electric connecting board, and the socket assembly is arranged on another end of the front of the electric connecting board, and plug terminals for plugging the two electrodes are symmetrically provided at the two ends of one side of the front of the electric connecting board, and plug ports of the plug terminals face an outer side of the electric connecting board, and a pin in the pin assembly is electrically connected to one of the plug terminals close to the pin through a circuit of the electric connecting board, and a connecting guide pin in the socket assembly is electrically connected to another plug terminal close to the connecting guide pin through the circuit of the electric connecting board, and the lower cover is provided with an accommodating cavity, and the pin assembly and the socket assembly are exposed outside the lower cover after the electric connecting board is placed in the accommodating cavity, and the upper cover is covered on the electric connecting board, and after the upper cover and the lower cover are matched and connected, insertion ports for inserting ends in the longitudinal direction of the LED light source board are respectively formed in two sides between the upper cover and the lower cover.

4. The LED light source assembly according to claim 3, wherein, positioning holes are respectively provided at two ends of each electrode in a longitudinal direction of the electrode , and a notch is formed by cutting one end of the plastic connector connecting the electrode and the LED light bar in a longitudinal direction of the plastic connector, and the notch extends to the closest positioning hole, and two positioning pillars are respectively arranged on two sides of the lower cover, and the positioning pillars are respectively positioned outside the insertion ports, and each of the positioning pillars is matched with the corresponding positioning hole to achieve positioning; and one end of the LED light source board with the notch is inserted into one of the insertion ports on a same side as the plug terminals, while another end of the LED light source board is inserted into the other insertion port, and parts of the electrodes separated by the notch are inserted into the plug terminals.

5. The LED light source assembly according to claim 4, wherein, two mounting strips are provided on an inner side of the upper cover in a longitudinal direction of the upper cover, a positioning strip is provided between middle positions of the two mounting strips, and a mounting pillar with a screw hole is arranged at each edge position between the two mounting strips, and the electric connecting board is provided with positioning through holes for the positioning strips to pass through, and mounting holes for the mounting pillars to pass through, and a positioning seat matched with the positioning strips and provided with a positioning groove is provided at a bottom of the accommodating cavity, and screw penetration holes matched with the mounting pillars are provided at the bottom of the accommodating cavity, and bottoms of the two mounting strips abut against the front of the electric connecting board to form the insertion ports on both sides between the upper cover and the lower cover after the upper cover and the lower cover are matched and connected.

6. The LED light source assembly according to claim 3, wherein, two mounting strips are provided on an inner side of the upper cover in a longitudinal direction of the upper cover, a positioning strip is provided between middle positions of the two mounting strips, and a mounting pillar with a screw hole is arranged at each edge position between the two mounting strips, and the electric connecting board is provided with positioning through holes for the positioning strips to pass through, and mounting holes for the mounting pillars to pass through, and a positioning seat matched with the positioning strips and provided with a positioning groove is provided at a bottom of the accommodating cavity, and screw penetration holes matched with the mounting pillars are provided at the bottom of the accommodating cavity, and bottoms of the two mounting strips abut against the front of the electric connecting board to form the insertion ports on both sides between the upper cover and the lower cover after the upper cover and the lower cover are matched and connected.

7. The LED light source assembly according to claim 6, wherein, the LED light bar comprises a metal substrate, and a plurality of LED units are sequentially processed on the metal substrate in a longitudinal direction of the metal substrate, and each of the plurality of LED units comprises a heat sink, an upper lead section located above the heat sink, a lower lead section located below the heat sink and an LED chip, and the heat sink is not connected to the upper lead section and the lower lead section, and two ends of the upper lead section are correspondingly connected to two ends of the lower lead section through a connecting bridge, and two ends of the heat sink are wide and a middle part of the heat sink is narrow to form an inner recess, and a protrusion that protrudes in a direction of the heat sink and is embedded in the inner recess is respectively provided on a middle part of the upper lead section and a middle part of the lower lead section, and the LED chip is mounted on a narrow area in the middle part of the heat sink, and two chip electrodes of the LED chip are respectively electrically connected to the two protrusions through wires, and the LED chip is coated with fluorescent glue, and all the LED chips are connected in series or in series and parallel by punching the connecting bridge.

8. The LED light source assembly according to claim 7, wherein, a first current limiting device is arranged on the front of the electric connecting board, and the first current limiting device is connected in series with the LED chip in the LED light source board that is electrically connected to the electric connecting board, and a surface of the LED light bar and a surface of the electrode are covered with a first protective layer.

9. A high-power lamp using the LED light source assembly according to claim 8, comprising a lamp cap, a lamp body, and a driving power supply arranged in the lamp body, wherein the high-power lamp further comprises a plurality of LED light source assemblies, a top ring, a top light source board, and a ring mask, and the lamp cap is connected with a narrow mouth portion of the lamp body, the top light source board is mounted on a top of the top ring, and the ring mask is covered outside the top light source board and connected to the top of the top ring, and when a number of the LED light source assembly is one, a top end of a wide mouth portion of the lamp body is connected to a bottom of the LED light source assembly, and the top ring is connected to a top of the LED light source assembly, and the socket assembly in the LED light source assembly is electrically connected with the driving power supply in a plug-in mode, and the pin assembly in the LED light source assembly is electrically connected with the top light source board in the plug-in mode, and a plurality of ventilation holes are uniformly provided in a bottom of the wide mouth portion of the lamp body, and walls of the wide mouth portion of the lamp body and the top ring in a circumferential direction thereof to form a chimney effect to achieve heat dissipation;

when the number of LED light source assemblies is multiple, two adjacent LED light source assemblies are connected by a connecting ring, and the top end of the wide mouth portion of the lamp body is connected with the bottom of the bottommost LED light source assembly, and the top ring is connected to the top of the topmost LED light source assembly, and the socket assembly in the bottommost LED light source assembly is electrically connected to the driving power supply in the plug-in mode, and the pin assembly in the topmost LED light source assembly is electrically connected to the top light source board in the plug-in mode, and the two adjacent LED light source assemblies are electrically connected by inserting the pins of the pin assembly into jacks of the socket assembly, and a plurality of ventilation holes are uniformly provided in a bottom of the wide mouth portion of the lamp body, and walls of the wide mouth portion of the lamp body, the connecting ring, and the top ring in a circumferential direction thereof to form a chimney effect to achieve heat dissipation.

10. The high-power lamp using the LED light source assembly according to claim 9, wherein, the lamp body comprises a power supply bin and a bin cover, the power supply bin has a horn structure, and a narrow mouth portion of the power supply bin is connected with the lamp cap; and the ventilation holes are provided in the bottom and the wall of the wide mouth portion of the power supply bin, and an inner cavity of the wide mouth portion is coaxially provided with an inner ring; and an outer wall of the inner ring and an inner wall of the wide mouth portion of the power supply bin are connected by a first connecting rib, and a plurality of first baffles are provided in an inner side of the wide mouth portion of the power supply bin in a circumferential direction of the power supply bin, and a first slot for fixing the LED light source board in the LED light source assembly is formed between the first baffle and a top end of the inner wall of the wide mouth portion of the power supply bin, and the inner ring is uniformly provided with air passing holes communicating with the ventilation holes in a circumferential direction of the inner ring, the inner ring is provided with an accommodating gap, and a circuit board of the driving power supply is provided with a first flange, and after the driving power supply is mounted in an inner cavity of the inner ring, the first flange is accommodated in the accommodating gap, and the first flange is provided with a power plug pin for inserting into the jack of the socket assembly, and heat dissipation through holes are provided in a top and wall of the bin cover, and a hollow connecting protrusion with a screw fixing pillar is provided on the top of the bin cover; and the screw fixing pillar on the hollow connecting protrusion is connected with the top ring when the number of the LED light source assembly is one, and the screw fixing pillar on the hollow connecting protrusion is connected with the connecting ring when the number of the LED light source assembly is multiple, and the power plug pin is exposed outside the bin cover after the bin cover is fixedly connected with the inner ring.

11. The high-power lamp using the LED light source assembly according to claim 10, wherein, a central cylinder with a counterbore pillar is coaxially arranged in the connecting ring, and the central cylinder extends downward;

a top of an outer wall of the central cylinder is connected with an inner wall of the connecting ring through a second connecting rib, and a plurality of second baffles are provided on the inner side of the connecting ring in a circumferential direction of the connecting ring, and second slots for fixing the LED light source board in the LED light source assembly are formed between the plurality of second baffles and the top end of the inner wall of the connecting ring and between the plurality of second baffles and the bottom end of the inner wall of the connecting ring, and a plurality of connecting pillars with screw holes are uniformly provided on the top of the central cylinder in a circumferential direction of the central cylinder, and positions of the plurality of connecting pillars with screw holes and the counterbore pillars on the central cylinder are staggered, and the counterbore pillar on the central cylinder in the bottommost connecting ring is connected with the screw fixing pillar on the hollow connecting protrusion, and the plurality of connecting pillars with screw holes in the topmost connecting ring are connected with the top ring, and two adjacent connecting rings are connected with each other through the connecting pillars with screw holes and the counterbore pillar on the central cylinder.

12. The high-power lamp using the LED light source assembly according to claim 11, wherein, a hollow lower boss with a screw hole pillar is coaxially arranged in a low part of the top ring, and an outer wall of the hollow lower boss and an inner wall of the top ring are connected through a third connecting rib, and the hollow lower boss and the third connecting rib encloses a pit used for mounting the driving power supply, and a plurality of third baffles are provided on the inner side of the top ring in a circumferential direction of the top ring, and third slots for fixing the LED light source board in the LED light source assembly are formed between the plurality of third baffles and the bottom end of the inner wall of the top ring, and when the number of the LED source assembly is one, the screw hole pillar on the hollow lower boss is connected with the screw fixing pillar on the hollow connecting protrusion, and when the number of the LED source assembly is multiple, the screw hole pillar on the hollow lower boss is connected to the connecting pillar with screw holes, and a positioning protrusion is provided on a horizontal surface of the third connecting rib, and a positioning gap matched with the positioning protrusion is provided on a periphery of the top light source board, and buckles are uniformly provided on the top of the top ring in the circumferential direction of the top ring, and clamping slots for clamping with the buckles are uniformly provided on a periphery of the ring mask, and the top light source board is provided with a second flange, and the second flange is provided with a plug jack for inserting the pin of the pin assembly.

13. The high-power lamp using the LED light source assembly according to claim 12, wherein, a second current limiting device is arranged on a surface of the top light source board, and the second current limiting device is connected in series with the LED chip in the top light source board, and the surface of the top light source board is covered with a second protective layer.

14. The high-power lamp using the LED light source assembly according to claim 9, wherein, a second current limiting device is arranged on a surface of the top light source board, and the second current limiting device is connected in series with the LED chip in the top light source board, and the surface of the top light source board is covered with a second protective layer.

15. The high-power lamp using the LED light source assembly according to claim 10, wherein, a second current limiting device is arranged on a surface of the top light source board, and the second current limiting device is connected in series with the LED chip in the top light source board, and the surface of the top light source board is covered with a second protective layer.

16. The high-power lamp using the LED light source assembly according to claim 11, wherein, a second current limiting device is arranged on a surface of the top light source board, and the second current limiting device is connected in series with the LED chip in the top light source board, and the surface of the top light source board is covered with a second protective layer.

* * * * *